United States Patent [19]

Miller

[11] Patent Number: 4,930,626

[45] Date of Patent: Jun. 5, 1990

[54] CARTRIDGE BOX

[76] Inventor: Jack L. Miller, 535 Pacific Ave., Alameda, Calif. 94501

[21] Appl. No.: 347,491

[22] Filed: May 3, 1989

[51] Int. Cl.[5] ..... B65D 43/12; B65D 85/20

[52] U.S. Cl. ..... 206/3; 224/196

[58] Field of Search ..... 206/3; 224/239, 196

[56] References Cited

U.S. PATENT DOCUMENTS

| | | | |
|---|---|---|---|
| 1,726,732 | 9/1929 | Doran | 206/3 |
| 2,386,546 | 4/1945 | Ely | 206/3 |
| 3,756,387 | 6/1973 | Chaney | 206/3 |
| 3,923,152 | 12/1975 | Minneman | 206/3 |
| 3,990,170 | 7/1976 | Griffis | 42/89 |

FOREIGN PATENT DOCUMENTS

| | | | |
|---|---|---|---|
| 220841 | 8/1924 | United Kingdom | 206/3 |
| 329537 | 5/1930 | United Kingdom | 206/3 |

*Primary Examiner*—William Price

[57] ABSTRACT

A cartridge box which holds a plurality of cartridges in spaced apart relation to each other and prevents them from rattling while entirely enclosed in the box. A cover for the box can be partially opened for exposing a predetermined number of the cartridges and novel means is provided for moving the exposed cartridges into a position where they can be readily removed from the box without disturbing the remaining cartridges. The novel cartridge moving means includes a cartridge carrier that has a plurality of spaced apart openings that are inclined from the vertical so as to incline the cartridges and make them more readily accessible for removal.

2 Claims, 1 Drawing Sheet

CARTRIDGE BOX

An object of my invention is to provide a cartridge box in which a cartridge carrier is slidably mounted for holding the cartridges in spaced apart relation to each other. A slidable and flexible cover normally closes the box and contacts with the cartridges to prevent them from rattling in the box. The cart ridges are arranged in rows and the cover can be partially opened for exposing one row of cartridges. The cartridge carrier can then be moved for causing the exposed row of cartridges to ride up on an inclined surface of the box and this inclined surface will partially eject the exposed cartridges from the carrier where they may be readily removed from the carrier and box.

DESCRIPTION OF PREFERRED EMBODIMENT

Figure 1:
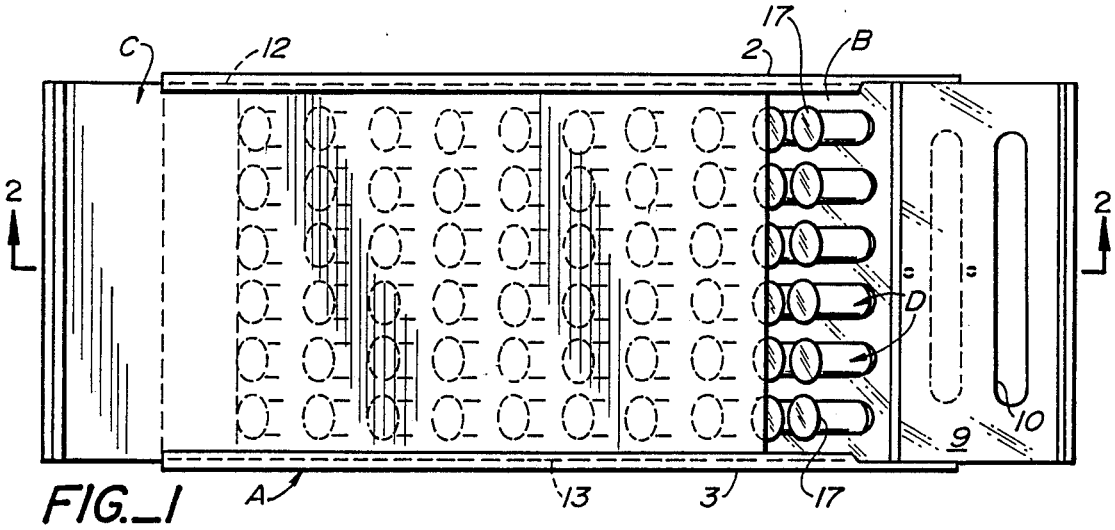
FIG. 1 is a top plan view of the cartridge box and shows the cover partially opened to expose one row of cartridges.

In carrying out my invention I provide a casing indicated generally at A and it may be made out of any desired material such as plastic. The casing has a flat bottom 1 and two parallel side walls 2 and 3 with the lower portions of each side wall inclined inwardly as shown in FIG. 3 for a purpose later to be described. The front portion of the bottom wall 1 is inclined upwardly at an angle at 1*a*, see FIG. 2, and the front end 1*b* of the inclined portion is made to parallel the main portion of the bottom wall. This front end has a slot 4 therein and a handgrip portion 5.

Figure 2:
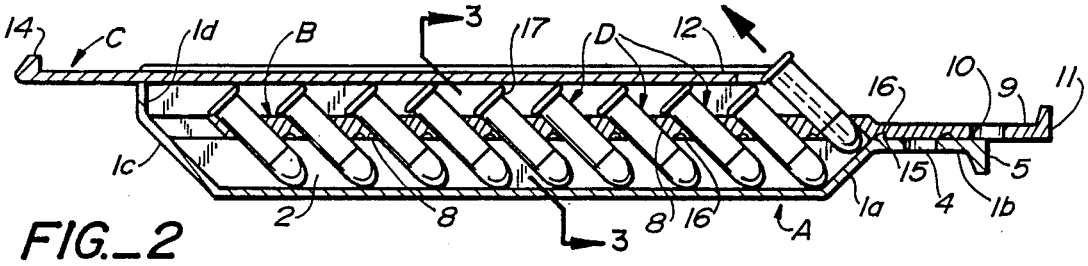
FIG. 2 is a longitudinal section through the cartridge box and it is taken along the line 213 2 of FIG. 1.
Figure 3:
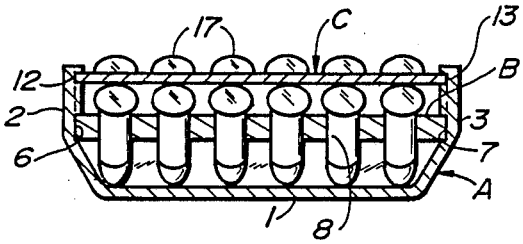
FIG. 3 is a transverse section through the box and it is taken along the line 3—3 of FIG. 2.

The rear of the bottom wall 1 is inclined upwardly at an angle as shown at 1*c* in FIG. 2, and then this end has a portion 1*d* lying in a plane that extends at right angles to the bottom wall. The width and the length of the bottom wall is great enough in area to contain a great number of cartridges.

Figure 4:
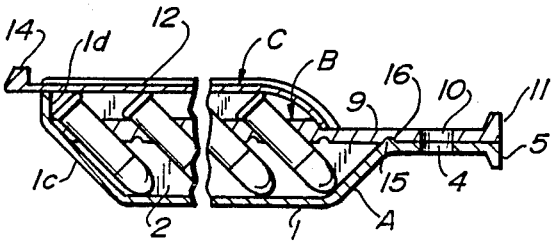
FIG. 4 is a further longitudinal section through the cartridge box similar to FIG. 2, but showing the slidable flexible cover in a closed position. The mid-portion of the box is not shown.

I provide a cartridge carrier B, of novel construction which has a width equal to that of the width of the casing A, and the side edges of the cartridge carrier are slidably received in longitudinally extending grooves formed on the inner surfaces of the side walls 2 and 3, see FIG. 3. The slidable carrier has a plurality of inclined openings 8 arranged in rows and six openings in each row are provided although I do not wish to be limited to any exact number. FIGS. 1 and 2 show the cartridge carrier as holding sixty cartridges. The front end of the carrier has a tongue 9 with a slot 10 and a hand grip portion 11 as clearly shown in FIGS. 1, 2 and 4. When the cartridge carrier is in the closed position as shown in FIG. 4, the two slots 4 and 10 will be aligned with each other and the hand grip 5 will register with the hand grip 11.

I provide a flexible slidable cover C whose side edges are received in longitudinal grooves 12 and 13 formed on the inner surfaces of the side walls 2 and 3 as shown in FIG. 3. The front ends of these two grooves are curved and inclined downwardly as shown by the groove 12 in FIG. 2 so that when the cover C, is closed, see FIG. 4, the front edge of the cover will contact the cartridge carrier B. The undersurface of the cover will contact the adjacent ends of the cartridges D and will hold the other cartridge ends in contact with the bottom wall 1 so as to prevent any rattling of the cartridges in the casing when the cover is closed. Also, the lower portions of the side walls 2 and 3 are inclined inwardly so that the end cartridges in each row will have their lower ends contacting the bottom wall and also contacting the inwardly inclined side wall portions where they join the bottom wall. In this way all of the cartridges are prevented from rattling when the cover closes the casing. The rear ends of the grooves 12 and 13 extend to the rear of the side walls 2 and 3 and permit the cover C to be retracted at shown in FIGS. 1 and 2 so as to expose the front row of cartridges D. The rear end of the cover has a hand grip portion 14 to aid the operator in closing and opening the cover.

The casing A has been specifically designed to partially eject the first row of cartridges D, as the cartridge carrier is pulled outwardly in FIG. 2 after the cover C has been opened sufficiently to expose the front cartridge row. As the cartridge carrier B, is pulled with respect to the casing A, the lower ends of the front row of cartridges will ride up on the inclined bottom wall portion 1*a* and this will force the front row of cartridges to be partially ejected from the openings 8 in the carrier. This will expose the tops of the cartridges in the front row so that they may be readily removed from the carrier and casing. As the carrier is moved forwardly in this manner, successive rows of cartridges will be partially ejected from their openings 8 for ready removal.

I provide a novel locking arrangement for holding the cartridge carrier B, in each position when a new row of cartridges are partially ejected from the carrier. In FIG. 2, I show the portion 1*b* of the casing provided with a small projection 15 that can enter a recess 16 on the underside of the carrier when the cartridges in the exposed row are partially ejected and ready to be removed. There are a plurality of these recesses 16 provided, one being positioned between each row of cartridges as shown. There is sufficient resiliency between portion 1*b* and the carrier B to permit the removal of the projection 15 from its associate recess 16 to allow the carrier to be moved to expose the next row of cartridges and yet the connection between the small projection 15 and its recess will prevent the accidental moving of the carrier with respect to the casing. When the cover C is closed, and the cartridge carrier B retracted, the two slots 4 and 10 will be aligned with each other to permit the casing to be hung on a support such as a hook or nail, not shown. Also, when the casing is closed, the two hand grips 5 and 11 are brought into juxtaposition permitting the device to be readily carried.

It will be noted from FIG. 2 that the inclination of the cartridges in the carrier B causes the cartridge rims 17 to be inclined with respect to the upper surface of the carrier and that most of the rim circumference of each cartridge extends above the carrier upper surface. If now the cover C is partially opened or entirely opened, this will expose the cartridge rims 17 where they may be readily grasped by the operator and permit the removal of the cartridges from the carrier even before the carrier is moved in the casing to cause the right hand row of cartridges to contact the upwardly inclined Portion la of the bottom wall 1 of the casing A.

I claim:

1. A cartridge box comprising (a) a casing having two side walls with a longitudinally extending groove on the inner surface of each side wall, the bottom wall of the casing having an upwardly inclined front end portion;

(b) a cartridge carrier slidably mounted in the grooves in the side walls and having a plurality of rows of cartridge-receiving openings, the axes of these openings being inclined with respect to the plane of the upper surface of the carrier so that the rims of the cartridges mounted in the openings will have their planes inclined to that of the carrier upper surface;

(c) a flexible cover slidable in two other longitudinally extending grooves in the casing side walls, these last two grooves being spaced above said first mentioned grooves and having their front portions inclined downwardly at an angle so that when the cover is closed, the front edge thereof will contact the carrier and enclose the cartridges in said carrier, the closed cover contacting the cartridge rims and holding the opposite ends of the cartridges in contact with the bottom casing wall for preventing the cartridges from rattling; and (d) said cover being slidably into partially open position for exposing the first row of cartridges and said carrier being movable for causing this first row of cartridges to have their lower ends ride upwardly on the inclined portion of the bottom wall for lifting the cartridge rims in the first row above the carrier upper surface where they may be manually removed.

2. The combination as set forth in claim 1; and in which;

(a) said carrier has a slot that is brought into registration with a slot in an extended portion of the bottom casing wall when the carrier is in the closed position;

(b) whereby the casing can be suspended from a supporting nail that extends through both slots and prevents relative movement between the carrier and the casing.

* * * * *